US012624627B2

(12) United States Patent
Belaskie et al.

(10) Patent No.: US 12,624,627 B2
(45) Date of Patent: May 12, 2026

(54) SYSTEMS AND METHODS FOR IDENTIFYING FRICTION FORCES IN A WELLBORE

(71) Applicant: Schlumberger Technology Corporation, Sugar Land, TX (US)

(72) Inventors: James Philip Belaskie, Houston, TX (US); Nathaniel Wicks, Cambridge, MA (US); Xianxiang Huang, Houston, TX (US); Brennan Daniel Goodkey, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 396 days.

(21) Appl. No.: 18/459,569

(22) Filed: Sep. 1, 2023

(65) Prior Publication Data

US 2024/0401458 A1 Dec. 5, 2024

Related U.S. Application Data

(60) Provisional application No. 63/506,171, filed on Jun. 5, 2023.

(51) Int. Cl.

| | |
|---|---|
| ***E21B 44/00*** | (2006.01) |
| ***E21B 44/02*** | (2006.01) |
| ***E21B 47/00*** | (2012.01) |

(52) U.S. Cl.

CPC ..... *E21B 44/00* (2013.01); *E21B 47/00* (2013.01)

(58) Field of Classification Search

CPC ..... E21B 44/00; E21B 47/00; E21B 44/04

USPC ..... 175/24, 25, 26, 27, 40, 50; 166/250.01

See application file for complete search history.

(56) References Cited

U.S. PATENT DOCUMENTS

| | | | | |
|---|---|---|---|---|
| 7,128,167 | B2 | 10/2006 | Dunlop et al. | |
| 10,473,816 | B2 | 11/2019 | Belaskie et al. | |
| 2014/0196949 | A1* | 7/2014 | Hareland | E21B 44/02 175/27 |
| 2018/0238162 | A1* | 8/2018 | Jeffryes | G01L 25/00 |
| 2019/0301273 | A1* | 10/2019 | Gillan | E21B 44/04 |
| 2023/0151696 | A1* | 5/2023 | Weideman | E21B 7/046 175/27 |
| 2023/0258074 | A1* | 8/2023 | Whitlow | E21B 44/04 175/40 |

OTHER PUBLICATIONS

Lenamond, Chris, "A Graphical Hole Monitoring Technique to Improve Drilling in High-Angle and Inclined Deepwater Wells in Real-Time," AADE 2003 National Technology Conference "Practical Solutions for Drilling Challenges", held at the Radisson Astrodome Houston, Texas, Apr. 1-3, 2003. (Year: 2003).*

(Continued)

*Primary Examiner* — Jonathan P Ouellette

(74) *Attorney, Agent, or Firm* — Kyle R. Miiller

(57) ABSTRACT

A friction manager may receive time data for hookload, weight-on-bit (WOB), and torque for a wellbore. A friction manager may use the time data for the hookload, the WOB, and the torque, to identify a section of steady-state motion in the wellbore. A friction manager may generate friction forces for the section of steady-state motion based on the time data for the hookload, the WOB, and the torque. A friction manager may adjust drilling activities based on the friction forces.

20 Claims, 11 Drawing Sheets

(56) References Cited

OTHER PUBLICATIONS

Cayeux, et al., "Accuracy and Correction of Hook Load Measurements During Drilling Operations", Mar. 2015, (SPE/IADC-173035-MS), 38 pages (Year: 2015).*
Cayeux, et al., "Challenges and Solutions to the Correct Interpretations of Drilling Friction Tests", Mar. 2017, (SPE/IADC-184657-MS), 39 pages (Year: 2017).*
Menand, S., "A New Buckling Severity Index to Quantify Failure and Lock-up Risks in Highly Deviated Wells", Jun. 2012, (SPE 151279), 15 pages (Year: 2012).*
Zha, et al., "Real Time Surface Data Driven WOB Estimation and Control", Sep. 2018, (SPE-191723-MS), 17 pages (Year: 2018).*
Belaskie, et al.,"A Practical Method to Minimize Stuck Pipe Integrating Surface and MWD Measurements", IADC/SPE Drilling Conference, Feb. 15-18, 1994, 16 pages.

* cited by examiner

SYSTEMS AND METHODS FOR IDENTIFYING FRICTION FORCES IN A WELLBORE

CROSS-REFERENCE TO RELATED APPLICATIONS

This application claims priority to and the benefit of U.S. Provisional Patent Application No. 63/506,171, filed on Jun. 5, 2023, which is hereby incorporated by reference in its entirety.

BACKGROUND OF THE DISCLOSURE

Drilling is used to access subterranean formations for exploration, the extraction of natural resources (e.g., oil, natural gas, water), power generation, other uses, and combinations thereof. A downhole drilling system includes a bit that is connected to a drill string and/or other downhole tools. During drilling activities, the drill string experiences forces based on the weight of the drill string, the upward force applied to the drill string, the torque applied to the drill string, and so forth. In some situations, the drill string may experience a sticking event that may increase the forces used to move the drill string.

SUMMARY

In some embodiments, the techniques described herein relate to a method. A friction manager receives time data for hookload, weight-on-bit (WOB), and torque for a wellbore. The friction manager, using the time data for the hookload, the WOB, and the torque, identifies a section of steady-state motion in the wellbore. The friction manager generates friction forces for the section of steady-state motion based on the time data for the hookload, the WOB, and the torque. The friction forces adjust drilling activities based on the friction forces.

In some aspects, the techniques described herein relate to a method. A friction manager receives first drilling data for a period for a drill string in a wellbore. The drilling data includes hookload data, weight-on-bit (WOB) data, and torque data. The friction manager applies a friction model to the first drilling data, the friction model resulting in a friction force for the drill string. The friction manager generates a determined hookload using the friction model and the friction force. The friction manager calibrates the friction model based on a comparison between the hookload data and the determined hookload, resulting in a calibrated friction model.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 through FIG. 2-3 are representations of friction management systems illustrating various friction forces, according to at least one embodiment of the present disclosure;

FIG. 3 is a representation of a friction manager, according to at least one embodiment of the present disclosure;

FIG. 5-1 and FIG. 5-2 are representations of hookload plots, according to at least one embodiment of the present disclosure;

DETAILED DESCRIPTION

This disclosure generally relates to devices, systems, and methods for determining a friction force of a drilling system. A friction management system receives drilling data, including hookload data, weight-on-bit (WOB) data, and torque data. The friction manager may apply a friction model to the drilling data. The friction model may determine a friction force using the drilling data. In some embodiments, the friction model may determine steady-state operating values for the drilling system. For example, the friction model may apply one or more filters to the drilling data to determine the steady-state operating values. Using the steady-state WOB and the steady-state hookload data, the friction manager may determine steady-state friction values and/or a steady-state friction coefficient. Using the steady-state friction values, the friction manager may help to determine whether a sticking event has occurred. This may help a drilling operator to identify sticking events earlier and/or more reliably. In this manner, the drilling operator may be able to mitigate the sticking event earlier, thereby reducing and/or preventing downtime and/or damage to the drilling system.

In accordance with at least one embodiment of the present disclosure, the friction manager may generate a predicted hookload for a future section of the wellbore. When the drilling system drills through the future section of the wellbore, the predicted hookload may be compared to the measured hookload. In some embodiments, the friction manager may calibrate the friction model resulting in a calibrated friction model. The calibrated friction model may align the modeled hookload with the measured hookload. In this manner, the friction model may be calibrated to be representative of the actual friction forces experienced by the drilling system. In some embodiments, the friction model may be calibrated while the drilling system is performing drilling activities. This may help the friction model to provide predicted hookloads that are based on the conditions of the current wellbore, thereby allowing a drilling operator to identify and/or mitigate a sticking event earlier.

Figure 1:
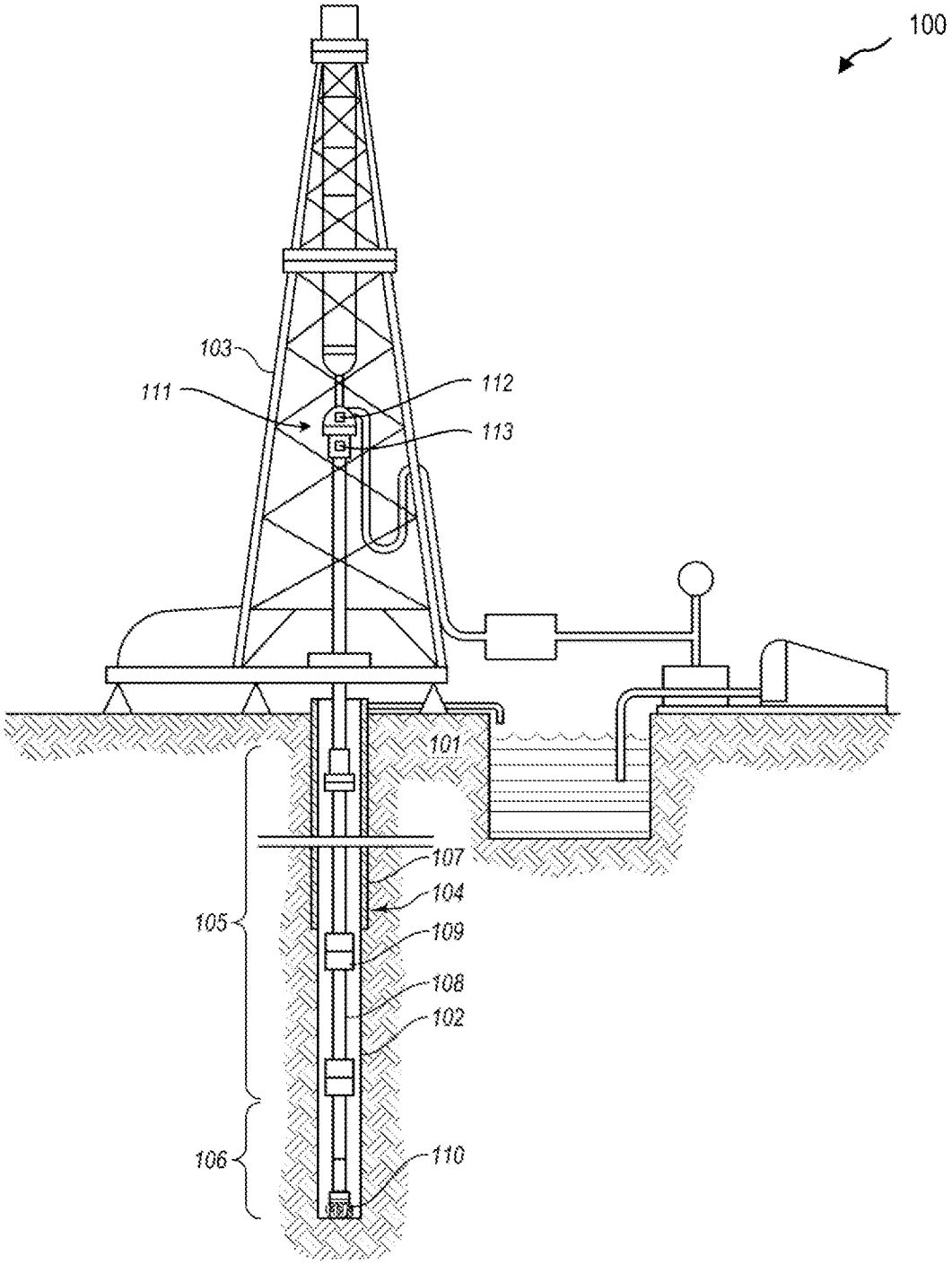
FIG. 1 is a representation of a drilling system for drilling an earth formation to form a wellbore, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include, but are not limited to, drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

During drilling activities, the weight of the drill string 105 is supported by the drill rig 103. While the drill string 105 is in the wellbore 102, the weight of the drill string 105 is suspended by a kelly, a top drive, a wire line, or other suspension mechanism 111. In the embodiment shown, the suspension mechanism is the blocks and top drive combination. However, it should be understood that the suspension mechanism may include any element or combinations of elements that suspend the drill string 105 and associated components. In some embodiments, the suspension mechanism 111 may help to provide and/or apply torque or rotary power to the drill string 105. The suspension mechanism 111 may include a hookload sensor 112. The hookload sensor 112 may be a sensor that detects the force applied to the suspension mechanism 111. For example, the hookload sensor 112 may include a force sensor that detects the downward force applied to the suspension mechanism 111 by the drill string 105. The hookload sensor 112 may include any type of sensor, such as a strain gauge, a pneumatic load cell, a hydraulic load cell, a piezoelectric element, a capacitive load cell, an inductive load cell, any other type of sensor, and combinations thereof.

The force applied to the suspension mechanism 111 may include the weight of the drill string 105. The weight of the drill string 105 may include the weight of each segment of drill pipe 108. In some embodiments, the weight of the drill string 105 may include the weight of each element of the BHA 106 and the weight of the bit 110. In some embodiments, the weight of the drill string 105 may be known. For example, the weight of each segment of the drill string 105 may be known. In some examples, each segment of the drill string 105 may be weighed as it is connected to the drill string 105. In some examples, the average weight of each segment of the drill string 105 may be known, based on previously weighed segments and/or volume and density values for the segments. As each segment of the drill string 105 is inserted into the wellbore 102, the type and weight of each segment may be recorded and the total weight recorded. As segments of the drill string 105 are removed from the wellbore 102, the weight of the associated segment may be subtracted from the total recorded weight. In this manner, the total weight of the segments of the drill string 105 may be tracked by maintaining records of each segment of the drill string 105 located in the wellbore 102.

In some embodiments, the hookload measured by the hookload sensor 112 may be the same or approximately the same as the total weight of the drill string 105. In some embodiments, the hookload measured by the hookload sensor 112 may be different than the total weight of the drill string 105. For example, the hookload measured by the hookload sensor 112 may be greater than the total weight of the drill string 105. In some examples, the hookload measured by the hookload sensor 112 may be less than the total weight of the drill string 105.

The difference between the measured hookload and the total weight of the drill string 105 may be based, at least in part, on friction forces experienced by the drill string 105 in the wellbore 102. Contact of the drill string 105 with the wellbore wall of the wellbore 102, and sliding of the drill string 105 along the wellbore wall, may result in friction forces that are applied to the drill string 105. These friction forces may result in a measured hookload that is different from the total weight of the drill string 105.

During drilling activities, the drill string 105 may be rotated. For example, the drill string 105 may be rotated to rotate the bit 110 to advance the wellbore, to rotate a reamer to increase the diameter of the wellbore 102, to rotate a casing cutter to remove a portion of the casing, to rotate any other downhole tool, and combinations thereof. In some examples, the drill string 105 may be rotated while tripping into or out of the wellbore 102. The drill string 105 may be rotated with a torque, which may be the torque applied to the drill string 105 to rotate at a particular RPM. The torque applied to the drill string 105 may be estimated based on a calculated rotational friction of the drill string 105, such as by determining the total weight and dimensions of the drill string 105 and determining the amount of torque that may be applied to rotate the drill string 105.

In accordance with at least one embodiment of the present disclosure, the drilling system 100 may include a torque sensor 113. The torque sensor 113 may be configured to measure the torque applied by the drilling system 100 to the drill string 105 at the surface. The torque sensor 113 may be located at any location of the drill rig 103 where torque may be measured, such as at the top drive, the kelly, the rotary table, any other location, and combinations thereof.

In some embodiments, the measured torque may be the same as the determined torque to rotate the drill string 105. In some embodiments, the measured torque may be different than the determined torque. The difference between the measured torque and the determined torque may be based on frictional contact with the wellbore wall. For example, the wellbore wall may apply a frictional force that opposes rotation of the drill string 105.

In accordance with at least one embodiment of the present disclosure, during drilling operations, a friction manager may determine the steady-state friction values for a particular drilling activity. The steady-state friction values may be based on a time-data measured by the hookload sensor 112 and/or the torque sensor 113. For example, the steady-state friction values for a particular drilling activity may be based, at least in part, on hookload time-data. As discussed in further detail herein, using trends over time that are filtered for various factors, the friction manager may determine the steady-state friction forces that are applied to the drill string 105. For example, the friction manager may determine the steady-state friction factor experienced by the drill string 105 during a particular drilling activity.

The friction manager may monitor the measured hookload and torque measured by the hookload sensor 112 and the torque sensor 113. In some embodiments, the friction manager may identify hookload and/or torque values that exceed the steady-state friction values. Identifying out-of-the-ordinary hookload and/or torque values may help the friction manager and/or a drilling operator to identify whether a sticking event has occurred and/or whether a sticking event is imminent. A sticking event may be an event in which the friction forces experienced by the drill string 105 are greatly increased. Sticking events may result in a decrease in the rate of penetration (ROP) of the drilling system 100. Sticking events may be caused by any increase in friction, such as through a buildup of cuttings or swarf. Detecting a sticking event may allow an automated drilling manager and/or the drilling operator to take remedial actions to resolve the sticking event. Examples of remedial action may include increasing a flow of drilling fluid to flush cuttings out of the wellbore 102, adjusting properties of the drilling fluid, adjusting the rotational rate of the drill string 105, adjusting the translational direction of the drill string 105, adjusting the rotational pattern of the drill string 105, changing the tripping direction of the drill string 105, any other remedial action, and combinations thereof. Implementing remedial actions upon the determination of a sticking event may help to reduce time and/or equipment losses that result from sticking events.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
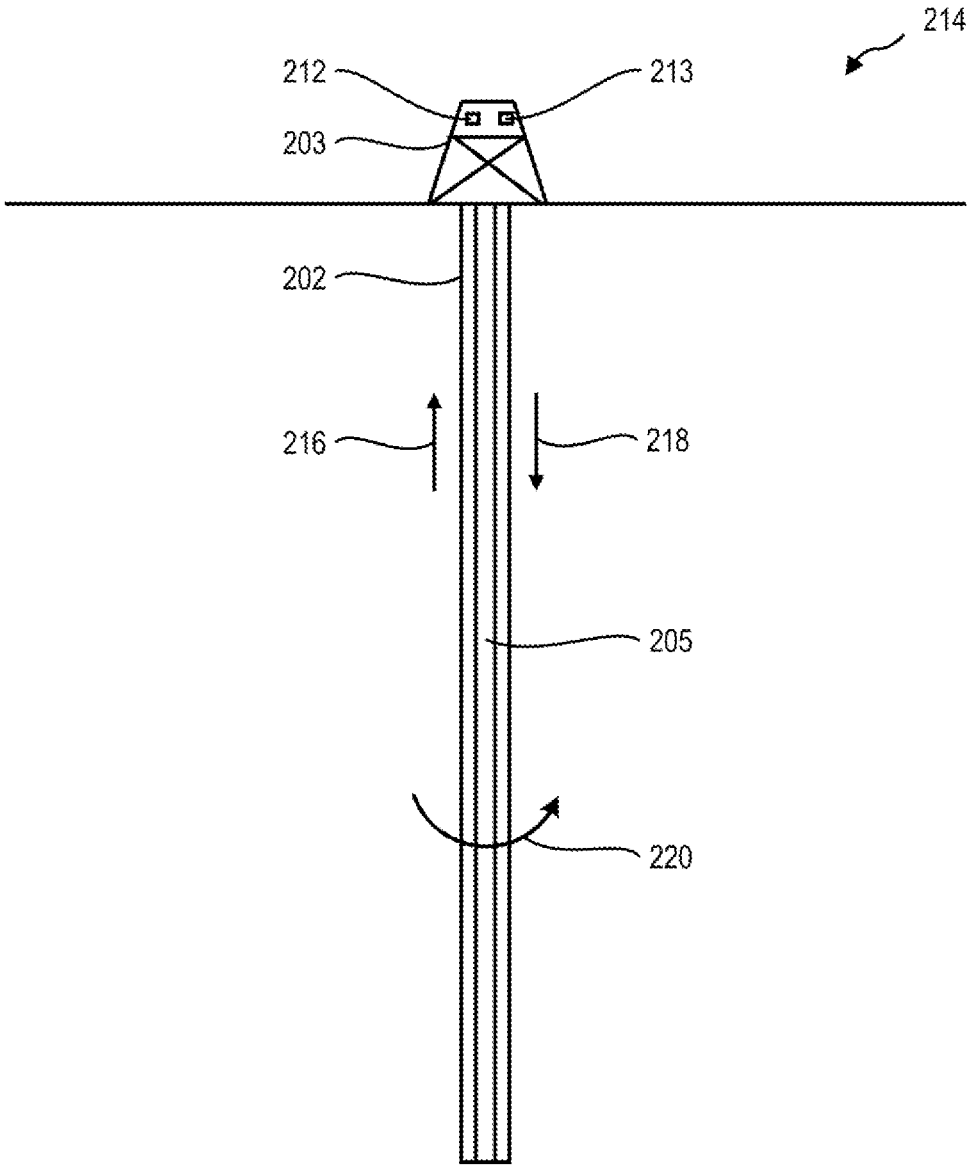
Figure 2:
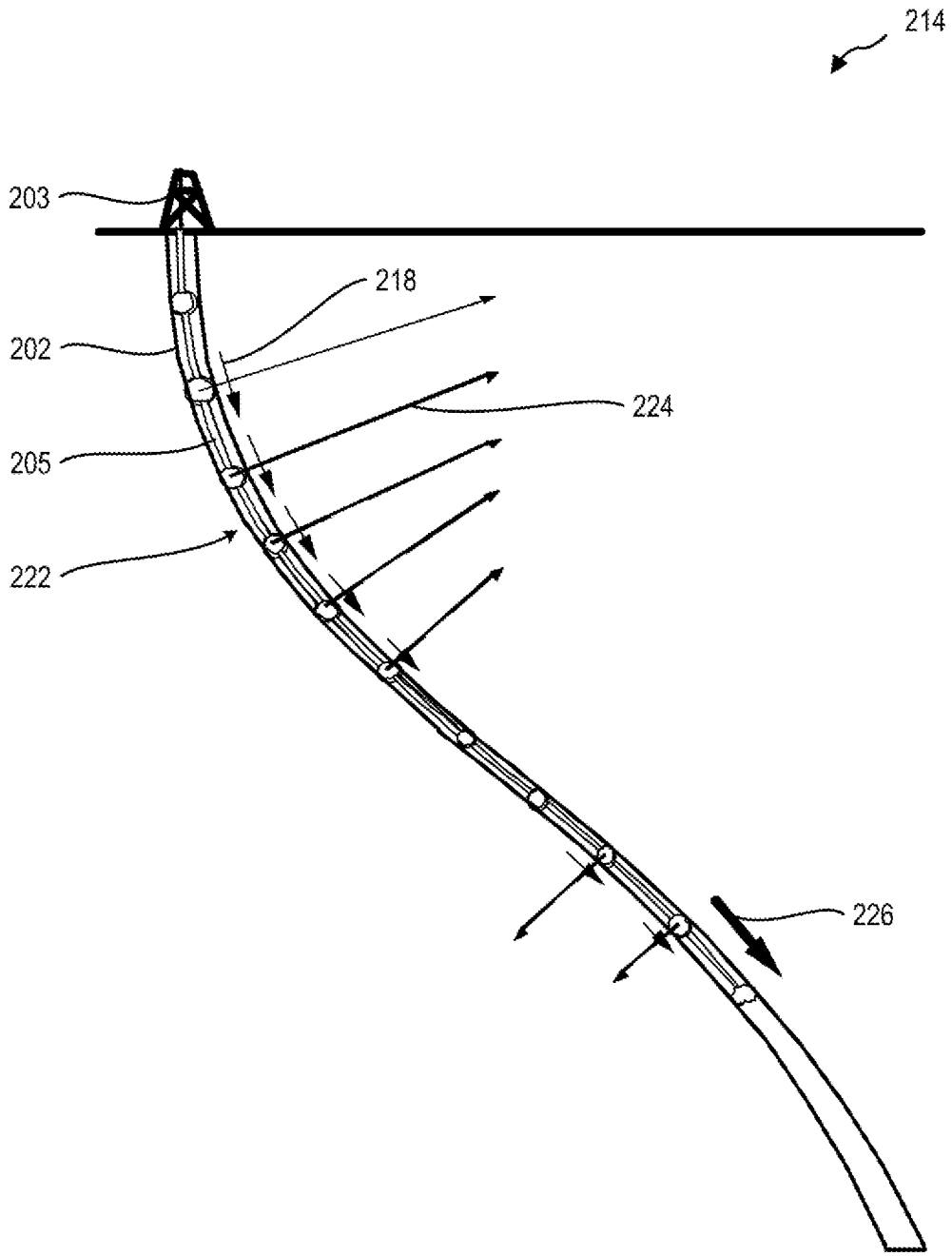

FIG. 2-1 is a representation of a friction management system 214, according to at least one embodiment of the present disclosure. The friction management system 214 includes a drill string 205 in a wellbore 202. In one configuration, the drill string 205 is supported by a drill rig 203. In the embodiment shown, the wellbore 202 is straight, and does not include any doglegs or other deviations in trajectory of the wellbore 202. As discussed herein, the drill rig 203 may include a hookload sensor 212 to measure a hookload of the drill string 205 and a torque sensor 213 to measure a torque applied to the drill string 205.

As discussed herein, during drilling activities, the drill string 205 may experience one or more friction forces. For example, while tripping the drill string 205 into the wellbore 202 and/or while advancing the depth of the wellbore or otherwise moving the drill string 205 downhole, the drill string 205 may experience an upward friction force 216. The upward friction force 216 may be a result of the contact of the drill string 205 with the wellbore wall of the wellbore 202, and the upward friction force 216 may oppose further insertion of the drill string 205 into the wellbore 202. As may be understood, the upward friction force 216 may increase the measured hookload measured from the hookload sensor 212.

In some examples, while tripping the drill string 205 out of the wellbore 202 or otherwise moving the drill string 205 uphole, the drill string 205 may experience a downward friction force 218. The downward friction force 218 may be a result of the contact of the drill string 205 with the wellbore wall of the wellbore 202. In one configuration, the downward friction force 218 may oppose further removal of the drill string 205 out of the wellbore 202. As may be understood, the downward friction force 218 may decrease the measured hookload as measured by the hookload sensor 212.

In some examples, while rotating the drill string 205 in the wellbore 202, the drill string 205 may experience a rotational friction force 220. The rotational friction force 220 may be a result of the contact of the drill string 205 with the wellbore wall of the wellbore 202 during rotation. In one configuration, the rotational friction force 220 may oppose further rotation of the drill string 205 out of the wellbore 202. As may be understood, the rotational friction force 220 may increase the measured torque measured from the torque sensor 213.

In accordance with at least one embodiment of the present disclosure, a friction manager may monitor the measured hookload from the hookload sensor 212 and the measured torque from the torque sensor 213. The friction manager may determine the steady-state friction forces of the drill string 205. For example, the friction manager may determine the friction forces experienced by the drill string 205 across a period of time. In some embodiments, the friction manager may determine, based on the friction forces, whether a sticking event has occurred. This may help the drilling manager and/or drilling operator to mitigate the sticking event earlier, thereby reducing the impact of the sticking event on the drilling system.

In the straight section of the wellbore 202 illustrated in FIG. 2-1, the upward friction force 216, the downward friction force 218, and the rotational friction force 220 may be relatively small. For example, contact with the wellbore wall by the drill string 205 may be relatively small, which may result in reduced friction forces. In this manner, the measured hookload and/or measured torque may be the same as or approximately the same as the total weight and/or the determined torque of the drill string 205.

During steady-state operation of the friction management system 214 in the straight section shown, the friction forces may be constant or relatively constant, and may not change or may only slightly change between sections of drill pipe. In this manner, the friction management system 214 may generate steady-state friction values for the drill string 205 in a straight section. As discussed herein, the steady-state friction values may be used in any manner. For example, the steady-state friction values may be used to calibrate the friction model. In some examples, the steady-state friction values may be used to determine the actual linear weight of the drill string 205. As discussed herein, the actual linear weight of the drill string 205 may be different than the linear weight of the drill string 205 used in the friction model based on differences in the type, wear, and state of the drill string 205. In some embodiments, the friction management system 214 may determine a sticking event or other abnormal friction force in the straight section using the steady-state friction values.

In FIG. 2-2, the wellbore 202 includes a dogleg 222, or a deviated portion of the wellbore 202, and the drill string 205 is being removed from the wellbore 202. In the dogleg 222, the drill string 205 may experience friction forces based on the contact of the wellbore wall at the dogleg 222. For example, the drill string 205 may experience a downward friction force 218 based on the upward motion of the drill string 205. The drill string 205 may further experience a side friction force 224. The side friction force 224 may be a result of the force of the contact of the drill string 205 with the wellbore wall at the dogleg 222. This may increase the total friction forces or friction factor of the wellbore at the wellbore depth.

In some embodiments, the friction manager may determine the steady-state friction forces by including at least a portion of the shape of the wellbore 202. For example, the friction manager may determine that the increased hookload measured at the drill rig 203 may be based at least in part on the side friction force 224 experienced at the dogleg 222.

In some situations, when tripping out of the wellbore 202, the drill string 205 may experience a sticking force 226. As discussed herein, the sticking force 226 may be a result of cuttings clogging the annulus of the wellbore between a portion of the drill string 205 and the wellbore wall of the wellbore 202. When the wellbore 202 experiences the sticking force 226, the friction manager may determine an increase in the measured hookload. Based on a comparison with the steady-state friction forces, the friction manager may determine that the increase in the friction forces may be a result of the sticking force 226. This may allow the drilling manager or drilling operator to determine that a sticking event has occurred. The drilling manager or drilling operator may implement one or more mitigation actions to mitigate the sticking event causing the sticking force 226.

During steady-state operation of the friction management system 214 in the curved section shown, the friction forces may be constant or relatively constant, and may not change or may only slightly change between sections of drill pipe. In this manner, the friction management system 214 may generate steady-state friction factors for the drill string 205 in the curved section. As discussed herein, the steady-state friction values may be used in any manner. For example, the steady-state friction values may be used to calibrate the friction model. In some embodiments, the friction management system 214 may determine a sticking event or other abnormal friction force in the curved section using the steady-state friction values.

Figures 2, 3:
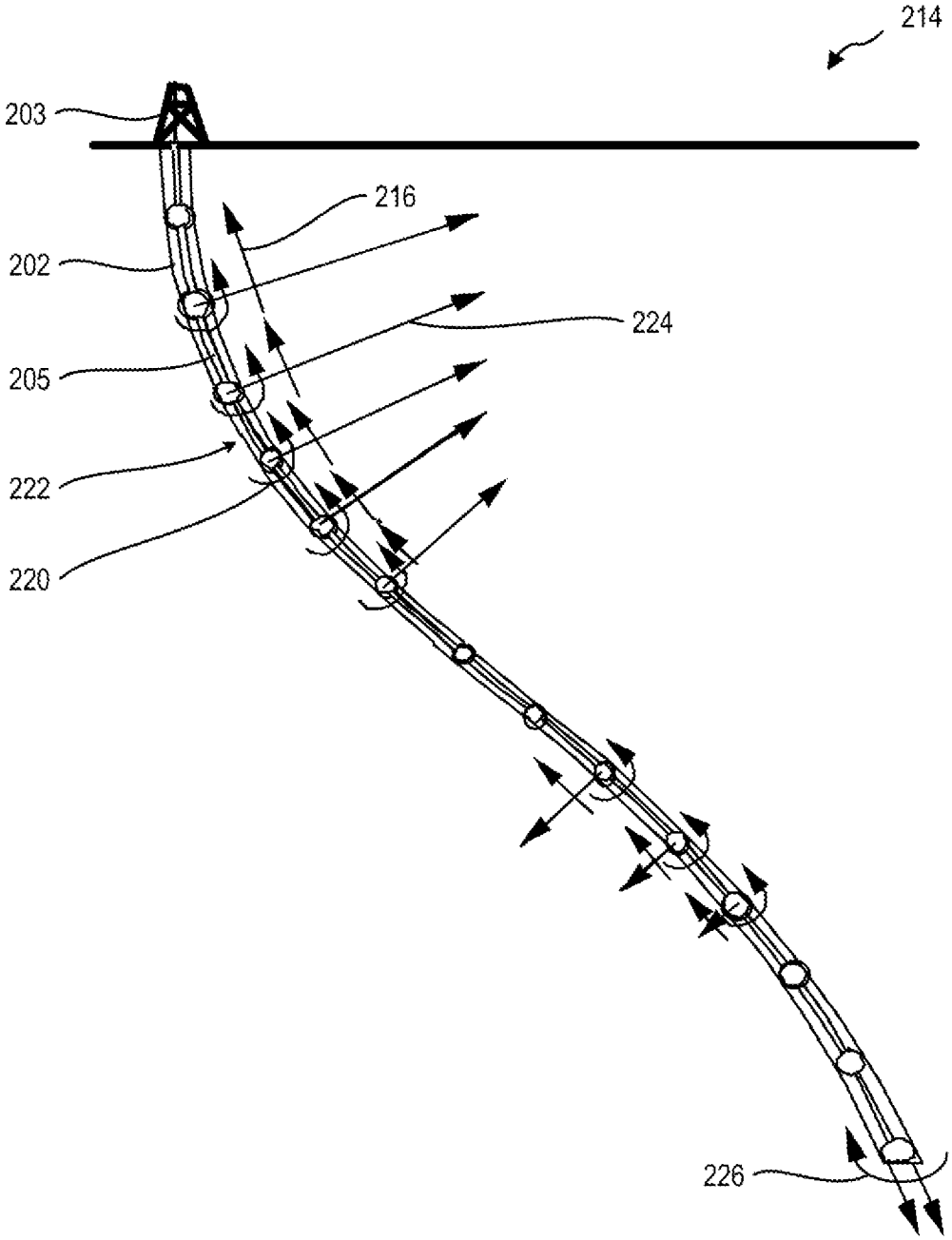
Figure 3:
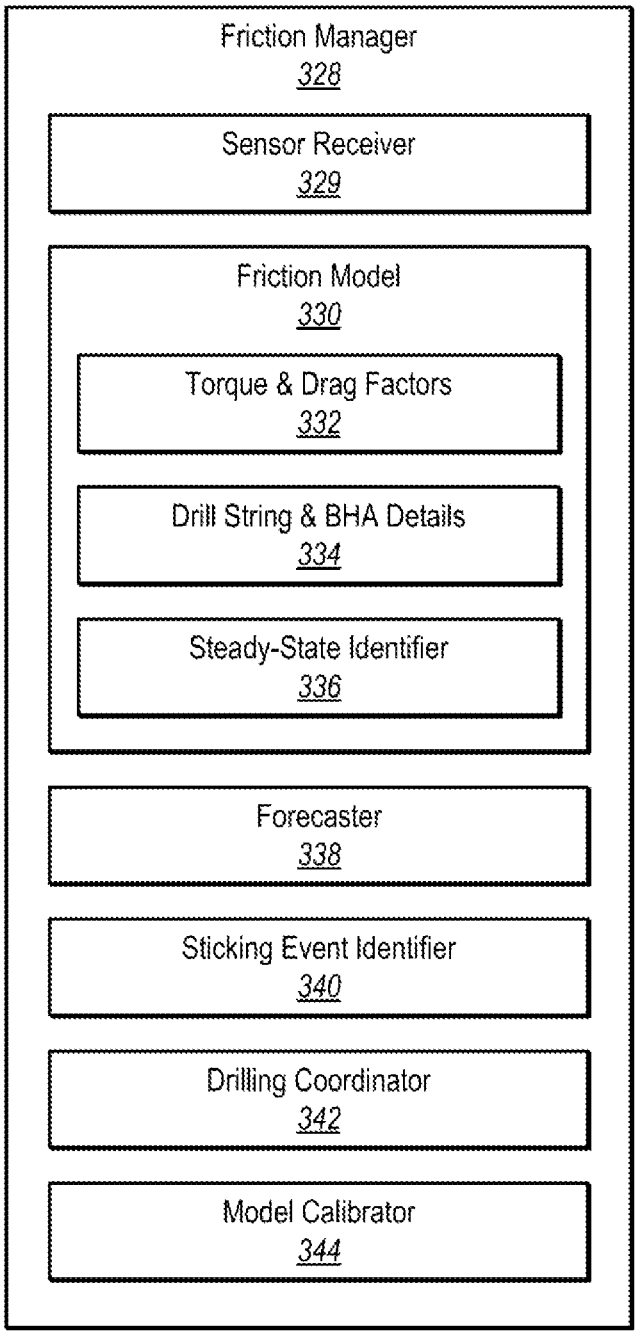

In FIG. 2-3, the wellbore 202 includes the dogleg 222, or a deviated portion of the wellbore 202, and the drill string 205 is advanced in the wellbore 202, such as through drilling, reaming, or other drilling activity that may result in a rotational motion. In the dogleg 222, the drill string 205 may experience friction forces based on the contact of the wellbore wall at the dogleg 222. For example, the drill string 205 may experience an upward friction force 216 based on the downward motion of the drill string 205. The drill string 205 may further experience a side friction force 224. The side friction force 224 may be a result of the force of the contact of the drill string 205 with the wellbore wall at the dogleg 222. This may increase the total friction forces or friction factor of the wellbore at the wellbore depth. The drill string 205 may further include a rotational friction force 220 based on the contact of the drill string 205 with the wellbore wall during rotation of the drill string 205.

As discussed herein, the friction manager may identify the steady-state friction forces for the drill string 205. In some embodiments, the friction manager may account for the friction experienced during the drilling activity shown in FIG. 2-3, including the upward friction force 216 resulting from the downward motion of the drill string 205, the side friction force 224 resulting from contact with the wellbore wall in the dogleg 222, and the rotational friction force 220 resulting from contact with the wellbore wall during rotation of the drill string 205. The steady-state friction forces may be identified over a period of time to account for measured variations in the hookload and/or torque values.

During drilling activities, the drill string 205 may experience one or more sticking forces 226. In the embodiment shown, the sticking forces 226 may resist downward and/or rotational motion by the drill string 205. While monitoring the hookload and/or torque measurements taken at the drill rig 203, the friction manager may identify the sticking force 226 by determining that the measured hookload and/or torque measurements have exceeded the steady-state friction values for the drill string 205. Identifying the sticking force 226 may help to identify a sticking event. Based on the identification of the sticking force 226, the drilling manager and/or the drilling operator may implement one or more mitigation actions to mitigate the sticking event. In accordance with at least one embodiment of the present disclosure, the friction manager may help to identify the sticking force 226 and/or a sticking event early, thereby reducing the impact that a sticking event may have on the drill string 205.

FIG. 3 is a representation of a friction manager 328, according to at least one embodiment of the present disclosure. Each of the components of the friction manager 328 can include software, hardware, or both. For example, the components can include one or more instructions stored on a computer-readable storage medium and executable by processors of one or more computing devices, such as a client device or server device. When executed by the one or more processors, the computer-executable instructions of the friction manager 328 can cause the computing device(s) to perform the methods described herein. Alternatively, the components can include hardware, such as a special-purpose processing device to perform a certain function or group of functions. Alternatively, the components of the friction manager 328 can include a combination of computer-executable instructions and hardware.

Furthermore, the components of the friction manager 328 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The friction manager 328 may monitor hookload and/or torque measurements received from hookload sensors and/or torque sensors associated with a drill string in a wellbore. Using the monitored hookload and/or torque measurements, the friction manager 328 may determine steady-state friction forces and/or a steady-state friction factor for the drill string in the wellbore. The steady-state friction forces and/or the steady-state friction factor may be used to identify abnormal hookload and/or torque measurements. The friction manager 328 may use the abnormal hookload and/or torque measurements to identify the presence of a sticking event, or the beginning of a sticking event. The friction manager 328 may coordinate with a drilling manager and/or a drilling operator to implement mitigation actions to cure and/or mitigate the severity of the sticking event.

The friction manager 328 may include a sensor receiver 329. The sensor receiver 329 may receive sensor measurements from a hookload sensor and/or a torque sensor. For example, the sensor receiver 329 may receive hookload and/or torque measurements. The friction manager 328 includes a friction model 330. The friction manager 328 may apply the friction model 330 to the measurements received by the sensor receiver 329. For example, the friction manager 328 may apply the friction model 330 to the hookload and/or torque measurements received by the sensor receiver 329. The friction model 330 may help to identify the steady-state friction forces and/or steady-state friction factors for the wellbore.

In some embodiments, the friction model 330 may include torque and drag factors 332 and drill string and BHA details 334. The torque and drag factors 332 may be based on the drill string and BHA details 334. For example, the torque and drag factors 332 may be based on the length of the drill string and BHA, the composition of the drill string and BHA, the weight of the drill string and BHA, drilling fluid composition, any other factors of the drill string and BHA, and combinations thereof. In some examples, the torque and drag factors 332 may include wellbore details, such as wellbore trajectory, formation type, presence of casing, any other wellbore details, and combinations thereof. The wellbore trajectory may calculate different friction forces and/or friction factors based on whether a portion of the wellbore is in a dogleg, the presence of casing, the presence of a particular formation type, any other factor, and combinations thereof.

In some embodiments, the BHA details 334 may include any details about the BHA and/or the drill string. For example, the BHA details 334 may include a weight of each element of the BHA and/or each length of drill string. In some examples, the BHA details 334 may include a wear status or other status of the tools in the BHA and/or the drill string. The friction model 330 may utilize the BHA details 334 to determine the friction forces on the drill string.

The friction model 330 may include a steady-state identifier 336. The steady-state identifier 336 may identify steady-state friction forces and/or steady-state friction factors during various states of the drill rig where the drill string experiences at least some motion. The states may include one or more of axial motion (e.g., uphole or downhole), rotation, pumping, in slips, on bottom, any other state, and combinations thereof. The sensor receiver 329 may receive force information, including hookload and torque measurements in each of these states. In some embodiments, the sensor receiver 329 may receive downhole measurements, including downhole WOB data and/or downhole torque on bit (TOB).

The drilling information received by the sensor receiver 329 may be time data. For example, the drilling information may receive data over time for hookload, torque, downhole WOB, downhole TOB, any other drilling information, and combinations thereof. The time data may be collected over a period of time, such as 1 s, 10 s, 30 s, 1 min., 2 min., 5 min., 10 min., 20 min., 30 min., 1 hr., 2 hr., 6 hr., 12 hr., 1 day, longer than 1 day, or any value therebetween. In some embodiments, the time data may be collected based on a duration of time that a particular operation occurs. For example, the time data may be collected over a duration of time that it takes to add or remove a length of drill pipe and/or multiple lengths of drill pipe from the drill string.

The steady-state identifier 336 may identify the steady-state friction forces and/or friction factors experienced over time by the drill string. In some embodiments, the steady-state identifier 336 may filter out one or more transitory forces. The drill string may experience transitory forces that do not impact the operation of drilling activities over time. Such transitory forces may be a result of transitory sticking mechanisms (e.g., sticking mechanisms that do not impact motion of the drill string over time), dynamic forces such as acceleration, any other transitory force, and combinations thereof.

To identify the steady-state friction forces and/or friction factors, the steady-state identifier 336 may identify a steady-state motion for the drill string. The steady-state motion may be identified using one or more filters that help to filter out the transitory forces. Such filters may filter various elements based on the rig state, the drilling activity, and other elements. By filtering the transitory forces, transitory motions, and other noise from the received measurements, steady-state motion values may be determined for a particular section of the drill string.

In accordance with at least one embodiment of the present disclosure, the friction model 330 may determine the friction forces and/or friction factors based on the steady-state motion of the drill string. For example, to determine the friction forces based on axial motion, the friction model 330 may identify a difference between the in situ drill string weight (as determined from the BHA details 334) and the measured hookload. As discussed herein, the in situ drill string weight may include the drill string, the wellbore trajectory and associated contact points, and the buoyancy of the drilling fluid. The friction model 330 may apply the torque and drag factors 332 to the resulting difference in the hookload to identify a friction force experienced by the drill string. The friction forces may be used to determine a friction factor for the section of the drill string. For example, the friction model 330 may apply the Coulomb friction model, which applies a friction factor to determine the normal friction force between two objects.

In some examples, to determine the friction forces based on rotational motion, the friction model 330 may identify a difference between the determined torque and the measured torque. The friction model 330 may apply the torque and drag factors 332 to the resulting difference in torque to identify a torque friction experienced by the drill string. The friction forces may then be used to determine a friction factor for the section of the drill string.

The forces experienced by the drill string may be consistent across sections. For example, the forces experienced by the drill string may change slowly. The friction manager 328 may include a forecaster 338 that may forecast the friction forces and/or the friction factor experienced by the drill string. For example, the forecaster 338 may forecast the friction forces and/or the friction factor that may be experienced by the drill string for the next section of the drill string. In some examples, the forecaster 338 may forecast a hookload and/or a torque measurement for a particular portion of the wellbore.

To determine the forecasted friction forces and/or friction factors, the forecaster 338 may identify the next section and/or sections of the drill string to be added. The forecaster 338 may determine the weight of the next section and/or sections and identify the impact on the hookload and/or torque measurements. In some embodiments, the forecaster 338 may identify the trajectory of the forecasted portion of the wellbore and may determine the impact the forecasted trajectory on the hookload and/or the torque measurements.

The friction manager 328 may further include a sticking event identifier 340. The sticking event identifier 340 may compare the forecasted hookload and/or torque values to the measured hookload and/or torque. Using the comparison between the forecasted hookload and/or torque values and the measured values, the sticking event identifier 340 may determine whether the measured hookload and/or torque values are different than the forecasted values such that the measured hookload and/or torque values are the result of a sticking event. In some embodiments, the sticking event identifier 340 may utilize instantaneous values to determine whether a sticking event has occurred. For example, the sticking event identifier 340 may determine whether a difference between the instantaneous value and the forecasted values is greater than an instantaneous threshold. The instantaneous threshold may be an indication that the instantaneously measured hookload and/or torque are not the result of transitory forces, but the result of a sticking event. The instantaneous threshold may help to quickly identify sticking events that occur suddenly.

In some embodiments, the sticking event identifier 340 may utilize steady-state values of the hookload and/or torque measurements (such as those identified by the steady-state identifier 336) to determine whether a sticking event has occurred. For example, the sticking event identifier 340 may determine whether a difference between the steady-state values and the forecasted value is greater than a steady-state threshold. The steady-state threshold may help to identify sticking events that occur slowly or over time, such that the instantaneous measurements may not exceed the instantaneous threshold. In some embodiments, the steady-state threshold may be lower than the instantaneous threshold.

If the sticking event identifier 340 identifies a sticking event, a drilling coordinator 342 may coordinate with a drilling manager and/or a drilling operator to implement mitigation actions to mitigate the sticking event. For example, the drilling coordinator 342 may communicate the identification of the sticking event to an automated drilling system. The automated drilling system may automatically implement a mitigation action to mitigate the sticking event. For example, the drilling coordinator 342 may maintain a set of mitigation actions that include a set of pre-defined remedial actions that may be taken for sticking in the wellbore. The drilling coordinator 342 may identify the pre-defined remedial actions that may be taken and may recommend one of the pre-defined remedial actions to the drilling manager and/or drilling operator. In some embodiments, the drilling coordinator 342 may communicate the identification of the sticking event to a drilling operator, such as a human drilling operator. The drilling operator may review the sticking event and determine whether to implement a mitigation action. In some embodiments, the drilling coordinator 342 may transmit the underlying data to the drilling manager and/or drilling operator for external review.

The friction manager 328 may include a model calibrator 344. The model calibrator 344 may calibrate the friction model 330 to the measured hookload and/or torque values. For example, during steady state motion, the model calibrator 344 may compare a determined hookload for a section of a drill string to the measured hookload. If the measured hookload for the section of the drill string is different from the determined hookload such that the measured hookload is not a result of a sticking event, the model calibrator 344 may adjust the friction model 330 so that the determined hookload is equal to or approximately equal to the measured hookload. As discussed herein, the hookload may be the total weight of the drill string plus the frictional forces of the drill string against the wellbore wall. For example, the model calibrator 344 may adjust one or more of the torque and drag factors 332 to calibrate the friction model 330. In some examples, the model calibrator 344 may adjust the BHA details 334, such as adjusting at least a portion of the total weight and/or the linear weight of the drill string. This may result in a friction model 330 that is more representative of the actual conditions in the wellbore. In some embodiments, calibrating the friction model 330 may result in a forecasted hookload that is more accurate or closer to the measured values for future sections of the wellbore.

In some embodiments, the model calibrator 344 may calibrate the friction model 330 while the drilling system is performing drilling activities. In some embodiments, the BHA details 334 may calibrate the friction model 330 while the drilling system is operating in steady state. For example, calibration may be performed when there is relative certainty that there are no sticking forces on the BHA. In some examples, the model calibrator 344 may calibrate the friction model 330 based on measured hookload and/or torque values before the wellbore is fully drilled, or while the drilling system is performing drilling activities. Calibrating the friction model 330 while the drilling system is performing the drilling activities may help to improve the accuracy and/or representation of the forecasted values by the forecaster 338. This may help to more accurately and/or earlier identify sticking events in the wellbore. In some embodiments, calibrating the friction model may help to preemptively identify sticking events in the wellbore.

In some embodiments, the model calibrator 344 may calibrate the friction model 330 after the wellbore is drilled. The calibrated friction model 330 may help the friction model 330 to be more representative in future wellbores.

Figure 4:
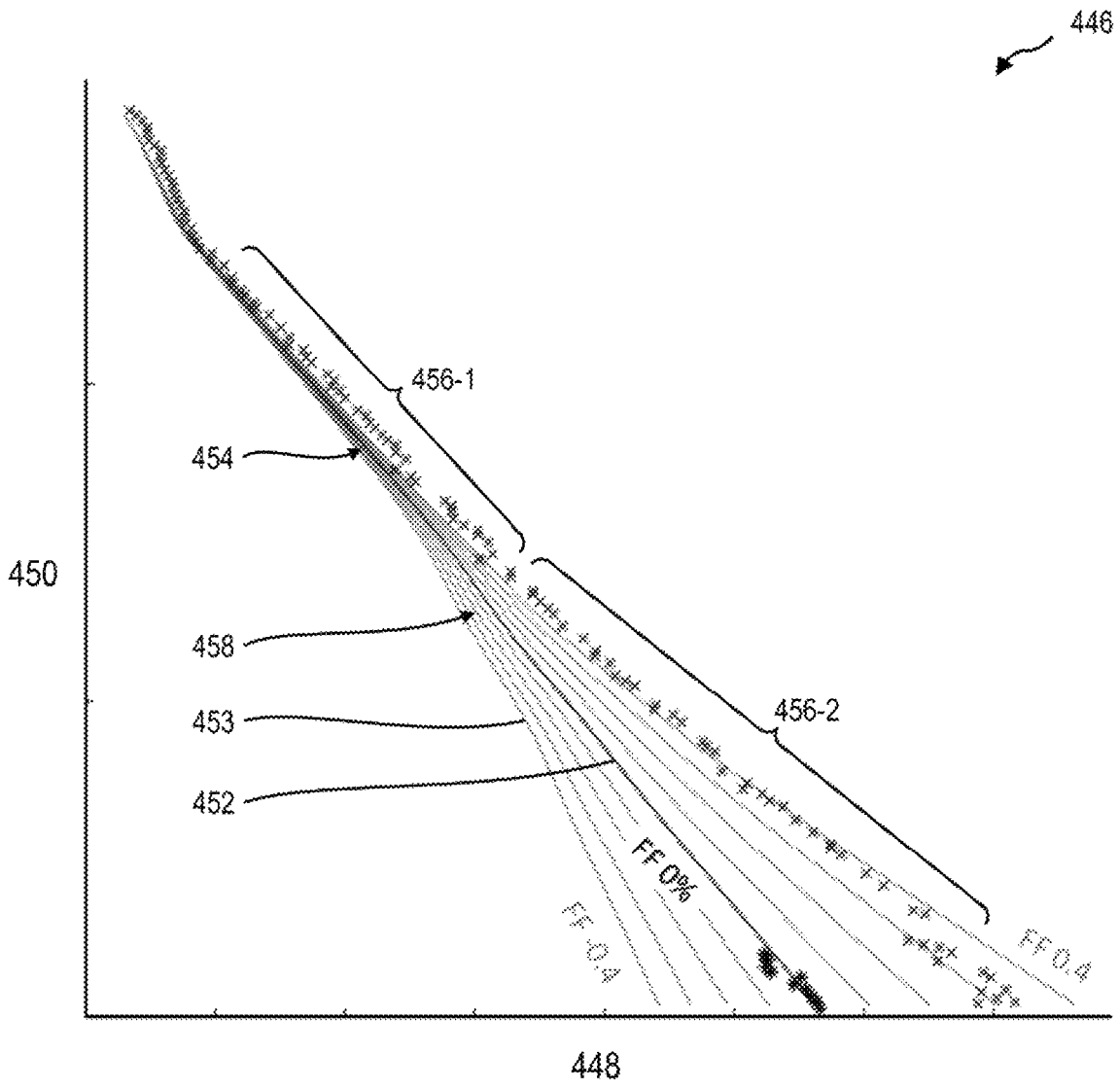
FIG. 4 is a representation of a hookload plot, according to at least one embodiment of the present disclosure.

FIG. 4 is a representation of a hookload plot 446 illustrating hookload 448 on the horizontal axis (e.g., the x-axis) and depth 450 on the vertical axis (e.g., the y-axis), according to at least one embodiment of the present disclosure. The hookload plot 446 illustrates a series of friction factors 453 calculated by a friction model (e.g., the friction model 330 of FIG. 3) plotted against depth, including a zero friction factor 452 stepping out to plus and minus 40% friction factors. Plotted on the hookload plot 446 are measured friction factors 454 for a sample wellbore.

As may be seen, the hookload plot 446 includes a first section of consistent friction factors 456-1 and a second section of consistent friction factors 456-2. At point 458, the wellbore first reached a total deviation of 20°. As may be seen, the measured friction factors 454 closely follow the plus 40% friction factor line, including with an adjustment at the point 458. These measurements show that the friction models in accordance with at least one embodiment of the present disclosure prepare friction factors that are representative of actual conditions in the wellbore.

Figures 1, 5:
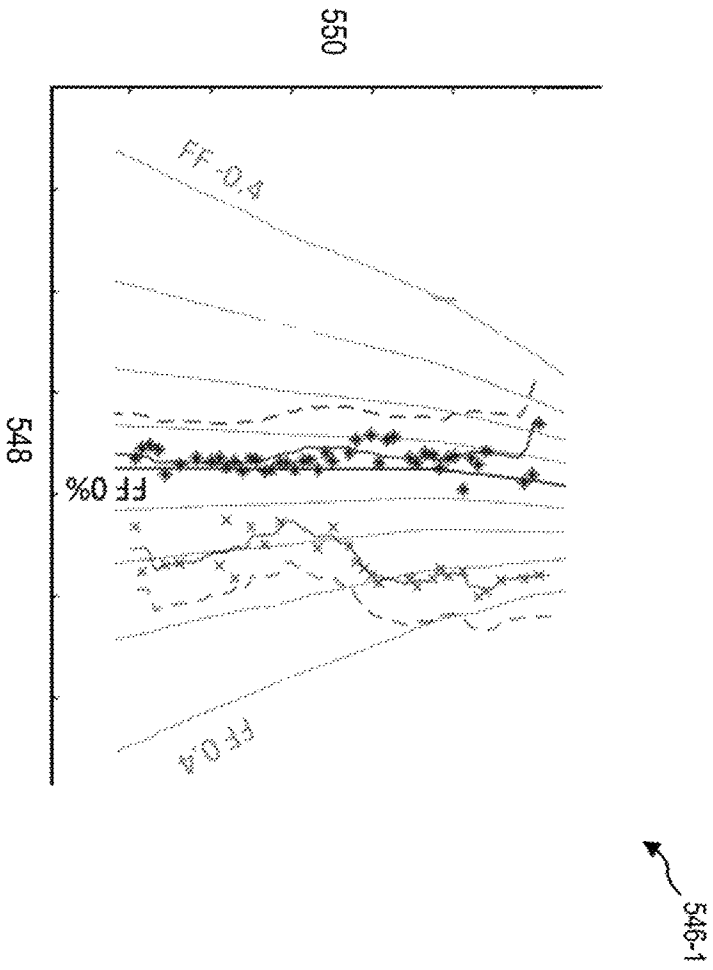
Figures 2, 5:
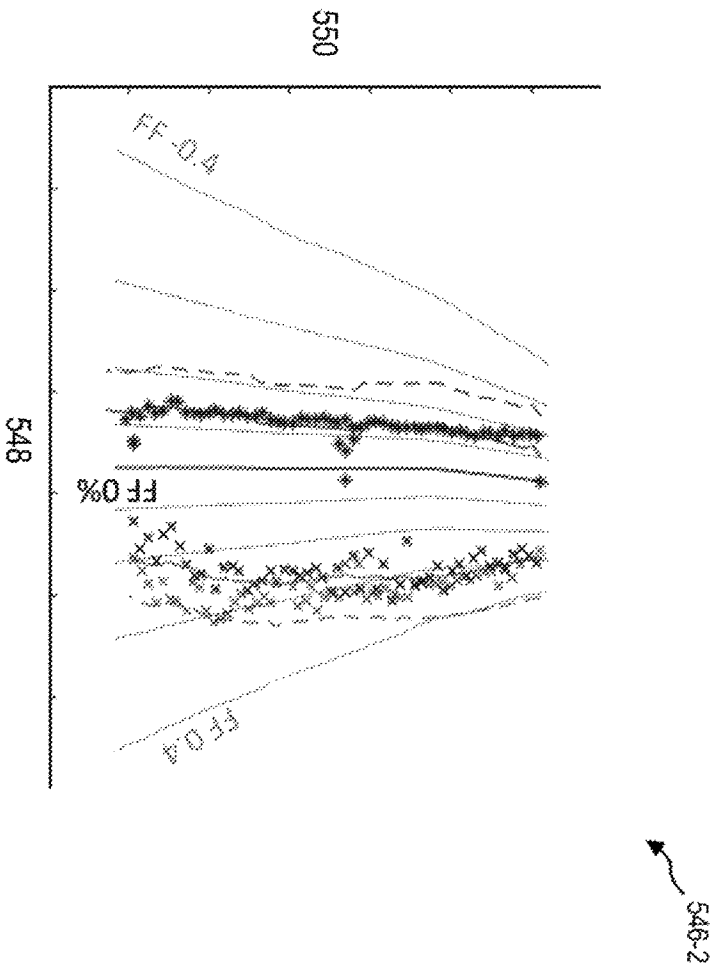

FIG. 5-1 is a representation of a first hookload plot 546-1 illustrating hookload 548 on the horizontal axis (e.g., the x-axis) and depth 550 on the vertical axis (e.g., the y-axis), according to at least one embodiment of the present disclosure. The first hookload plot 546-1 illustrates a series of friction factor lines 553 calculated by a friction model (e.g., the friction model 330 of FIG. 3) plotted against depth, including a zero friction factor 552 stepping out to plus and minus 40% friction factors. Plotted on the first hookload plot 546-1 are measured reaming hookloads 560, including a steady-state reaming hookload line, and measured pull-up hookloads 562 (e.g., measured, steady state, per stand), including a steady-state pull-up line, for drilling activities. A reaming offset 564 is offset from the steady-state hookload line by a threshold, and a pull-up offset 566 is offset from the steady-state pull-up line by a threshold.

During drilling of the sample wellbore, the sample wellbore did not experience a sticking event. This may be seen by the measured hookloads that do not exceed the offset hookloads in the first hookload plot 546-1.

FIG. 5-2 is a representation of a second hookload plot 546-2 illustrating hookload 548 on the horizontal axis (e.g., the x-axis) and depth 550 on the vertical axis (e.g., the y-axis), according to at least one embodiment of the present disclosure. The second hookload plot 546-2 illustrates a series of friction factors calculated by the friction model plotted against depth, including a zero friction factor 552 stepping out to plus and minus 40% friction factors. Plotted on the second hookload plot 546-2 are measured reaming hookloads 560, including a steady-state reaming hookload line, and measured pull-up hookloads 562, including a steady-state pull-up line, for tripping activities. A reaming offset 564 is offset from the steady-state hookload line by a threshold, and a pull-up offset 566 is offset from the steady-state pull-up line by a threshold.

During drilling of the sample wellbore in the exemplary representation of FIG. 5-2, the sample wellbore did not experience a sticking event. This may be seen by the measured hookloads that do not exceed the offset hookloads in the second hookload plot 546-2. In some embodiments, a comparison between the first hookload plot 546-1 and the second hookload plot 546-2 may show the friction progression from drilling to tripping. In some situations, drilling may have less sticking, at least in part because the BHA may be in contact with the new formation, the drill string is moved slower at drilling connections, and drilling fluid is circulating. During tripping, the formation has been exposed to the wellbore for longer, drilling fluid may not circulate, and the tripping speeds may be faster, resulting in higher friction forces.

In accordance with at least one embodiment of the present disclosure, a friction manager may autonomously generate the friction profiles shown in FIG. 5-1 and FIG. 5-2 in real-time during drilling operations. For example, the friction manager may receive the hookload data for the drilling operation and may apply the hookload data to the friction model. This may output a friction factor. The friction manager may generate the friction profile automatically during the drilling operation. In this manner, the drilling operator may identify anomalous friction factors during the drilling operation, thereby reducing the impact of a friction event on the operation. In some embodiments, the friction manager may generate the friction profile in real-time or near real-time. For example, the friction manager may receive the hookload measurements and, upon receipt, generate the friction factor and plot the friction factor on the friction profile. Generating the friction profile in real-time may further help the drilling operator to quickly identify a sticking event or other anomalous friction factor as it is occurring. This may allow the drilling operator to quickly respond to the event, thereby reducing or eliminating the impact on the drilling operation.

In some embodiments, the normal friction profiles generated by the friction manager may be used to identify a progression or regression of friction during drilling activities and/or over any interval. For example, the slopes of the normal friction profiles may be used to identify when friction conditions change. The drilling operator may review the change in friction conditions. In some embodiments, the drilling operator may review the change in friction conditions to identify a change in drilling activity (e.g., on-bottom drilling, tripping, making drilling connections). In some embodiments, the drilling operator may review the change in friction conditions to identify a change in the wellbore geometry (e.g., a change in dogleg severity). In some embodiments, the operator may review the change in friction conditions to identify a friction event (e.g., sticking, stick-slipping).

Figure 6:
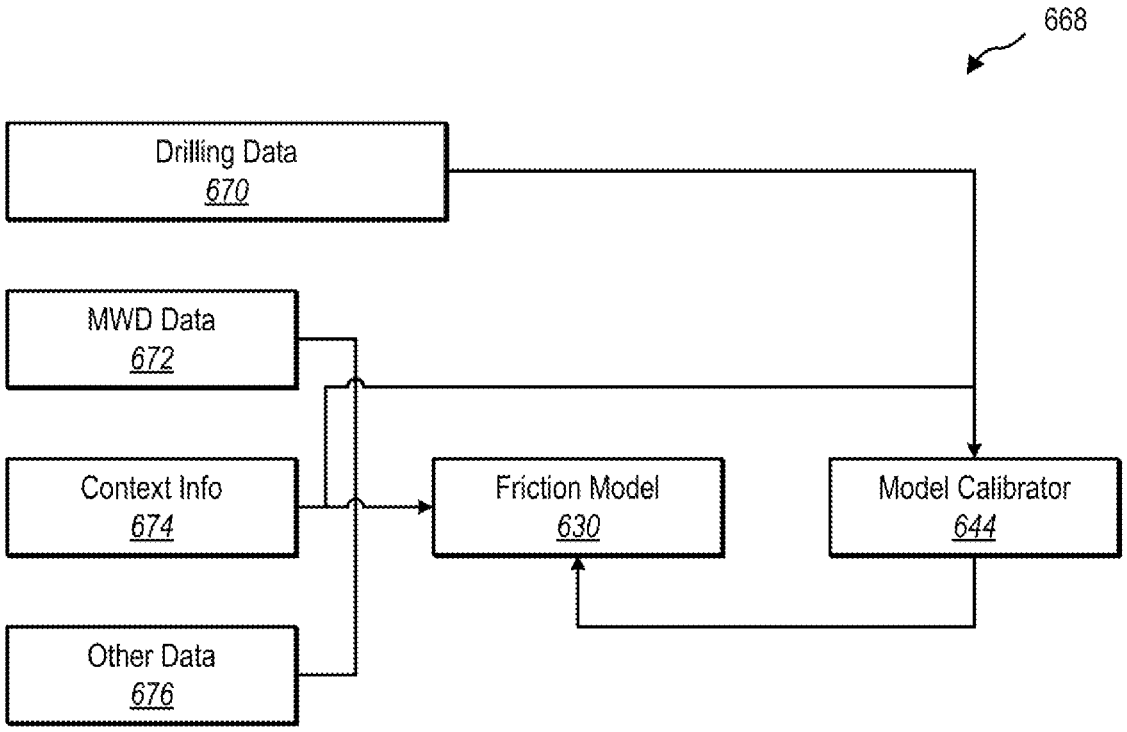
FIG. 6 is a representation of a method for calibrating a friction model, according to at least one embodiment of the present disclosure.
Figure 7:
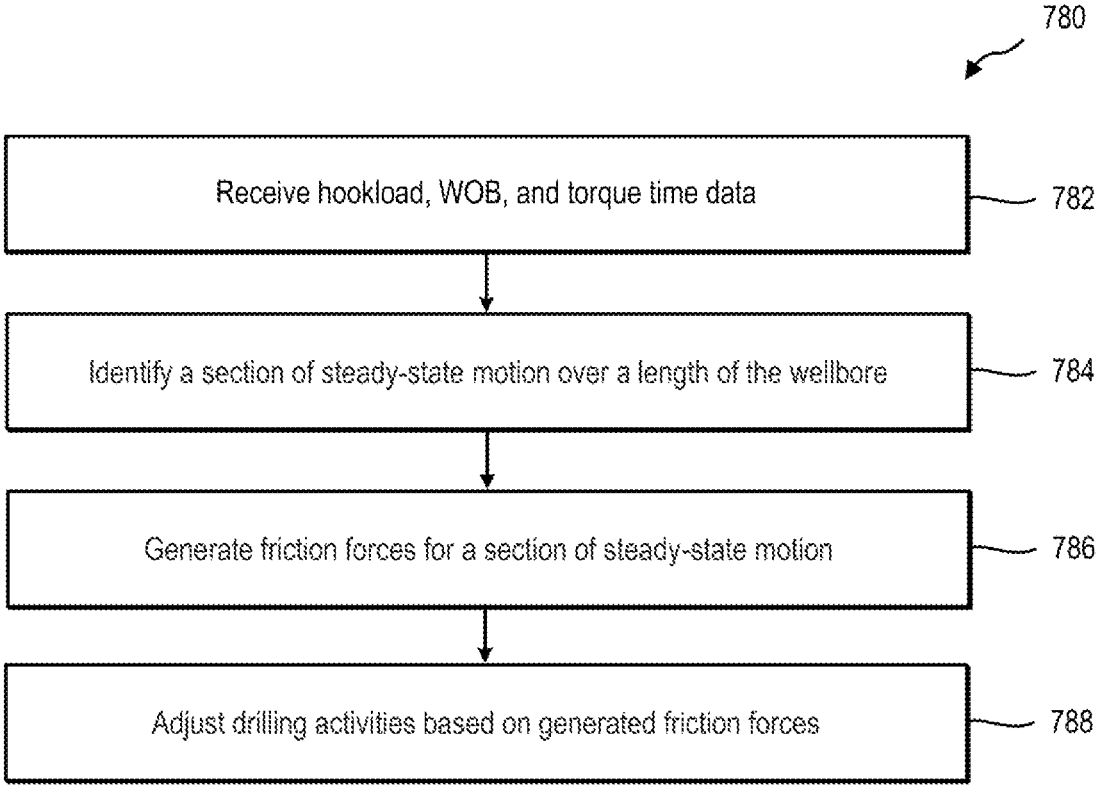
FIG. 7 is a representation of a method for determining wellbore friction, according to at least one embodiment of the present disclosure.
Figure 8:
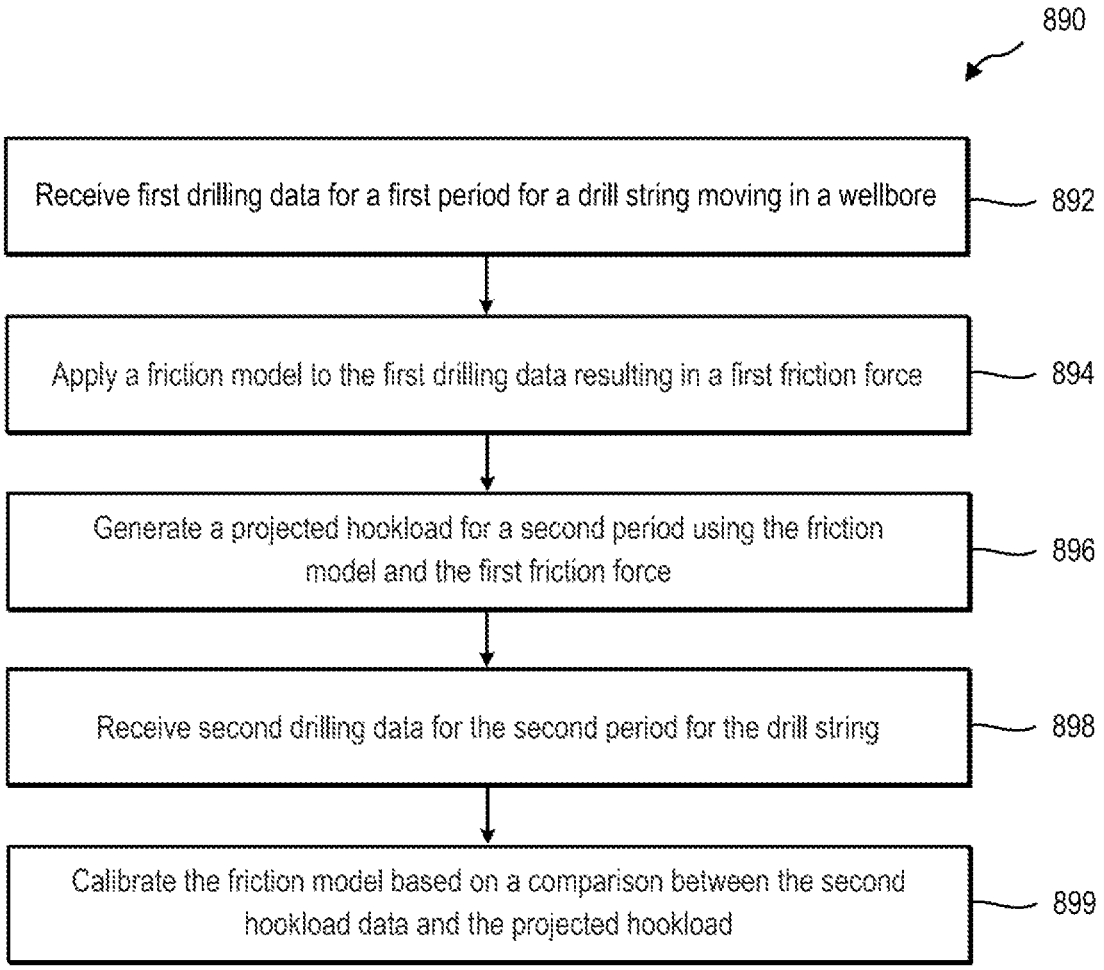
FIG. 8 is a representation of a method for determining wellbore friction, according to at least one embodiment of the present disclosure.

FIG. 6-8, the corresponding text, and the examples provide a number of different methods, systems, devices, and computer-readable media of the friction management systems discussed herein. In addition to the foregoing, one or more embodiments can also be described in terms of flowcharts that are representative of processes (e.g., computer implemented processes) that are electronically executed as shown in FIG. 6-8. FIG. 6-8 may be performed with more or fewer acts. Further, the acts may be performed in differing orders. Additionally, the acts described herein may be repeated or performed in parallel with one another or parallel with different instances of the same or similar acts.

As mentioned, FIG. 6 illustrates a flowchart of a method 668 for calibrating a friction model, in accordance with at least one embodiment of the present disclosure. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable medium can comprise instructions that, when executed by one or more processors, cause a computing device to perform the acts of FIG. 6. In some embodiments, a system can perform the acts of FIG. 6.

In accordance with at least one embodiment of the present disclosure, a model calibrator 644 may receive drilling data 670. For example, the model calibrator 644 may receive hookload and/or torque sensor data from one or more hookload sensors and/or torque sensors. The model calibrator 644 may receive friction model data from the model calibrator 630. For example, the model calibrator 644 may receive projected hookloads from the model calibrator 630.

The projected hookloads may be for a portion of the wellbore that is already drilled. The model calibrator 644 may compare the measured drilling data 670 to the projected hookloads over the same period as the projected hookload. Based on the comparison between the projected hookload and the measured drilling data 670 over the same period, the model calibrator 644 may adjust the model calibrator 630. For example, the model calibrator 644 may adjust the torque and drag computations and/or linear weight of the drill string so that the calculated hookload matches the measured hookload from the model calibrator 644.

As discussed herein, the model calibrator 630 may receive as input BHA data 672, contextual information 674, and other information 676. For example, the model calibrator 630 may receive any type of BHA data 672, such as drill string weight, drill string material, any other BHA data 672, and combinations thereof. The model calibrator 630 may further receive contextual information 674, such as wellbore depth, wellbore trajectory, casing depth, formation information, mud weight, mud formulation, any other contextual information 674, and combinations thereof. In some embodiments, the model calibrator 644 may receive at least a portion of the contextual information 674.

As mentioned, FIG. 7 illustrates a flowchart of a method 780 for determining friction forces in a wellbore, in accordance with at least one embodiment of the present disclosure. While FIG. 7 illustrates acts according to one embodiment, alternative embodiments may omit, add to, reorder, and/or modify any of the acts shown in FIG. 7. The acts of FIG. 7 can be performed as part of a method. Alternatively, a computer-readable medium can comprise instructions that, when executed by one or more processors, cause a computing device to perform the acts of FIG. 7. In some embodiments, a system can perform the acts of FIG. 7.

In accordance with at least one embodiment of the present disclosure, a friction manager may receive drilling time data, including but not limited to, hookload, WOB, and torque time data for a wellbore at 782. In some embodiments, the friction manager may receive the drilling time data based on time data over a period of time. In some embodiments, the friction manager may receive the drilling time data based on time data for a particular section of the wellbore, the total duration of which may vary from section to section and/or based on the drilling activity performed.

In some embodiments, using the drilling time data, the friction manager may identify a section of steady-state motion in the wellbore at 784. For example, the friction manager may identify a length of the wellbore over which the drill string experiences steady-state motion. In some examples, the friction manager may identify a period of time over which the drill string experiences steady-state motion.

The friction manager may generate friction forces for the section of steady-state motion based on the drilling time data at 786. In some embodiments, the friction manager may generate friction factors for the section of steady-state motion based on the drilling time data. In some embodiments, generating the friction forces may include generating axial friction forces (e.g., friction forces parallel to a longitudinal axis of the wellbore). In some embodiments, generating the friction forces may include generating a rotational friction force. In some embodiments, generating the friction forces may include generating a side force in a dogleg of the wellbore. In some embodiments, generating the friction forces may include determining a difference between the hookload and a total weight of the drill string in the wellbore.

In accordance with at least one embodiment of the present disclosure, the drilling manager may adjust drilling activities based on the friction forces at 788. For example, the drilling manager may cause a drilling manager and/or a drilling operator to adjust drilling activities by adjusting a rate of axial movement of the drill string, adjusting a rotational speed of to the drill string, adjusting an axial direction of the drill string, adjusting a drilling fluid pressure, adjusting a drilling fluid composition, adjusting any other drilling activity, and combinations thereof.

In accordance with at least one embodiment of the present disclosure, the friction manager may identify, based on the drilling time data, abnormal friction forces. The friction manager may identify that the abnormal friction forces include a sticking event.

As mentioned, FIG. 8 illustrates a flowchart of a method 890 for determining friction forces in a wellbore, in accordance with at least one embodiment of the present disclosure. While FIG. 8 illustrates acts according to one embodiment, alternative embodiments may omit, add to, reorder, and/or modify any of the acts shown in FIG. 8. The acts of FIG. 8 can be performed as part of a method. Alternatively, a computer-readable medium can comprise instructions that, when executed by one or more processors, cause a computing device to perform the acts of FIG. 8. In some embodiments, a system can perform the acts of FIG. 8.

A friction manager may receive first drilling data for a period for a drill string moving in a wellbore at 892. The first drilling data may include hookload data, WOB data, and torque data. In some embodiments, the period may be a period of time, such as a set period of time. In some embodiments, the period may be a length of the drill string, such as a segment of drill pipe, which may have a variable period of time. The hookload data, the WOB data, and the torque data may be measured over the period. In some embodiments, the period may include a certain number of measurements of the hookload data, the WOB data, and the torque data.

In some embodiments, the friction manager may generate a determined hookload using the friction model. The determined hookload may be determined for the period, or at least a portion of the period over which the hookload data is received and/or measured. In accordance with at least one embodiment of the present disclosure, the friction manager may compare the determined hookload to the measured hookload. If the determined hookload is different than the measured hookload, the friction manager may calibrate the friction model until the determined hookload is the same as the measured hookload.

In some embodiments, the friction manager may calibrate the friction model by making changes to one or more inputs to the friction model and comparing the determined hookload to the measured hookload. This process may be iterated until the determined hookload matches the measured hookload. For example, the friction manager may iterate changes to the linear weight of the drill pipe. Due to wear, corrosion, and other factors, the input value for the linear weight of the drill pipe in the friction model may not be representative of the actual linear weight of the drill pipe, and iterating the linear weight of the drill pipe input may help to further calibrate the friction model. In some examples, the friction manager may iterate changes to the wear of the drill string and/or drill string components to match the calibration points of the friction model. This may help provide a stable portion of the friction model that does not change or changes slowly over the wellbore section.

In some embodiments, the friction model may be calibrated using multiple weight points. For example, the friction model may be calibrated using measured block weight while the drill string is in slips moving as a low friction point in the model. A free weight calibration may be performed at the drilling connections as a high friction point in the model. The wear on the drilling string components, including the drill pipe, may be adjusted to match the calibration points. This may help to provide a stable value for friction that remains relatively constant over time.

In some embodiments, the slope and magnitude of the normal friction force over depth of the wellbore during a trip in a cased portion of wellbore may be used to further calibrate the torque and drag factors of the friction model. This may help to refine the estimated wear of the BHA components and/or the upper drill pipe in a drilling operation.

In accordance with at least one embodiment of the present disclosure, the friction manager may perform calibration while the drilling system is drilling in a steady-state manner. For example, the friction manager may calibrate the friction model while the drilling system is drilling with little to no variation in friction forces. In some examples, the friction manager may calibrate the friction model while the drilling system is in a period of reduced axial friction. In some examples, the friction manager may calibrate the friction model during drilling operations where axial friction is minimized. Calibrating the friction model during drilling operations with limited axial friction may improve the calibration by limiting the number of variables that impact the friction model.

The friction manager may receive second drilling data for the second period for the drill string at 898. The second drilling data may include, but may not be limited to, second hookload data, second WOB data, and second torque data. The friction manager may calibrate the friction model based on a measured hookload, WOB, and torque operating at a steady-state at 899. This may result in a calibrated friction model. In some embodiments, the calibrated friction model may be more representative of conditions at the wellbore.

In accordance with at least one embodiment of the present disclosure, calibrating the friction model may include calibrating the friction model while performing drilling activities. For example, calibrating the friction model may occur in real-time while the drill string is moving. This may help the friction model to be representative of the actual conditions in the wellbore.

In some embodiments, calibrating the friction model may include comparing a determined weight of the drill string during a period of low to no axial friction, such as during stationary rotating, plus the first friction force to the hookload to determine a hookload difference. The friction model may be calibrated by iterating torque and drag factors and/or drill pipe linear weight until the hookload difference is reduced below a calibration threshold.

In some embodiments, the friction manager may further receive third drilling data for a third period. The third drilling data may include third hookload data, third WOB data, and third torque data. The friction manager may apply the calibrated friction model to the third drilling data, resulting in a third friction force. Based on the third friction force, the friction manager may identify a sticking event for the drill string in the wellbore.

Figure 9:
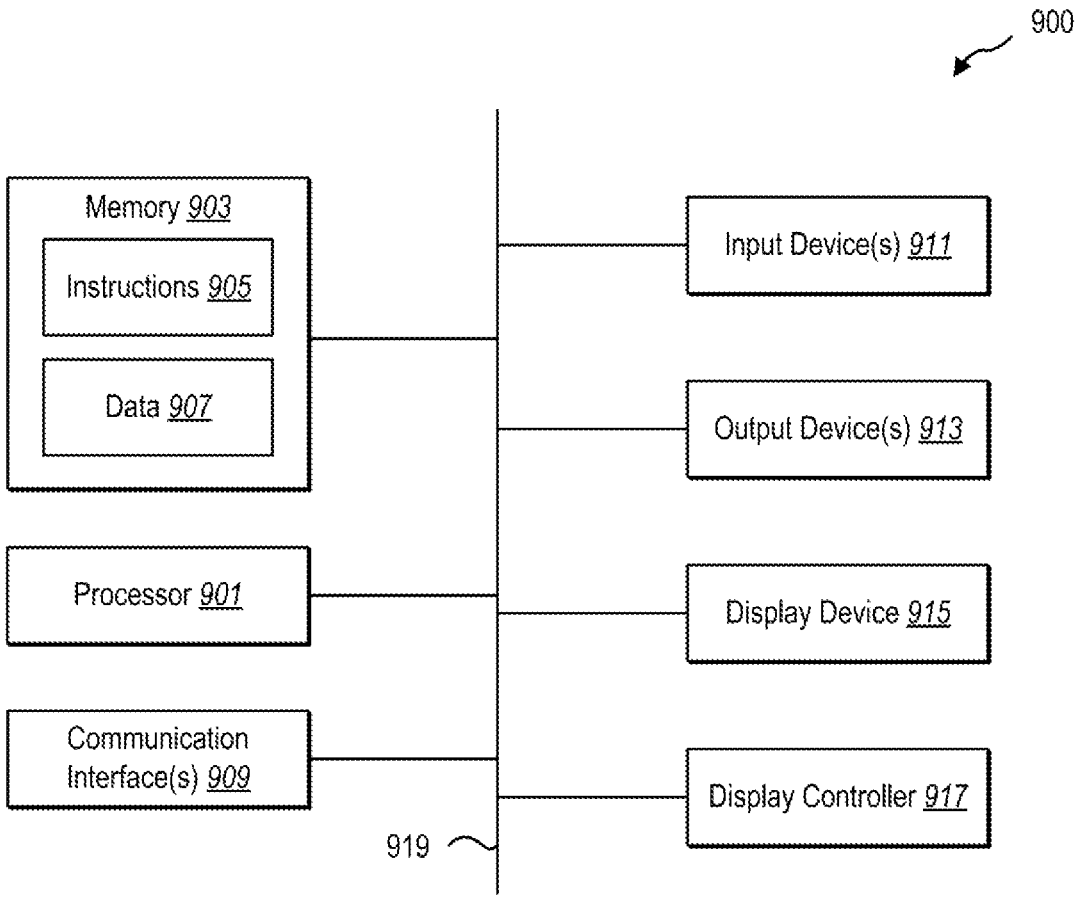
FIG. 9 is a representation of a computing system, according to at least one embodiment of the present disclosure.

FIG. 9 illustrates certain components that may be included within a computer system 900. One or more computer systems 900 may be used to implement the various devices, components, and systems described herein.

The computer system 900 includes a processor 901. The processor 901 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 901 may be referred to as a central processing unit (CPU). Although just a single processor 901 is shown in the computer system 900 of FIG. 9, in an alternative configuration, a combination of processors (e.g., an ARM and DSP) could be used.

The computer system 900 also includes memory 903 in electronic communication with the processor 901. The memory 903 may be any electronic component capable of storing electronic information. For example, the memory 903 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 905 and data 907 may be stored in the memory 903. The instructions 905 may be executable by the processor 901 to implement some or all of the functionality disclosed herein. Executing the instructions 905 may involve the use of the data 907 that is stored in the memory 903. Any of the various examples of modules and components described herein may be implemented, partially or wholly, as instructions 905 stored in memory 903 and executed by the processor 901. Any of the various examples of data described herein may be among the data 907 that is stored in memory 903 and used during execution of the instructions 905 by the processor 901.

A computer system 900 may also include one or more communication interfaces 909 for communicating with other electronic devices. The communication interface(s) 909 may be based on wired communication technology, wireless communication technology, or both. Some examples of communication interfaces 909 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 900 may also include one or more input devices 911 and one or more output devices 913. Some examples of input devices 911 include a keyboard, mouse, microphone, remote control device, button, joystick, trackball, touchpad, and lightpen. Some examples of output devices 913 include a speaker and a printer. One specific type of output device that is typically included in a computer system 900 is a display device 915. Display devices 915 used with embodiments disclosed herein may utilize any suitable image projection technology, such as liquid crystal display (LCD), light-emitting diode (LED), gas plasma, electroluminescence, or the like. A display controller 917 may also be provided, for converting data 907 stored in the memory 903 into text, graphics, and/or moving images (as appropriate) shown on the display device 915.

The various components of the computer system 900 may be coupled together by one or more buses, which may include a power bus, a control signal bus, a status signal bus, a data bus, etc. For the sake of clarity, the various buses are illustrated in FIG. 9 as a bus system 919.

The embodiments of the friction manager have been primarily described with reference to wellbore drilling operations; the friction managers described herein may be used in applications other than the drilling of a wellbore. In other embodiments, friction managers according to the present disclosure may be used outside a wellbore or other downhole environment used for the exploration or production of natural resources. For instance, friction managers of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method, comprising:

receiving, for a period of time while performing a drilling activity with a drill rig state, time data for hookload, weight-on-bit (WOB), and torque for a wellbore, wherein the period of time is based on a duration of time that it takes to adjust a total drill pipe length of a drill string, the drill string having a specification weight;

using the time data for the hookload, the WOB, and the torque for the wellbore, identifying a section of steady-state motion in the wellbore over the period of time, wherein, in the section of steady-state motion, the drill string in the wellbore has reduced axial friction;

generating friction forces for the section of steady-state motion by applying a friction model to the time data for the hookload, the WOB, and the torque;

using the friction forces, the total drill pipe length, and the time data for the hookload over the period of time, identifying an adjusted linear weight of the drill string;

calibrating the friction model based on the adjusted linear weight of the drill string, resulting in a calibrated friction model;

generating adjusted friction forces by applying the calibrated friction model to the time data for the hookload, the WOB, and the torque; and adjusting the drilling activity based on the adjusted friction forces.

2. The method of claim 1, further comprising identifying abnormal friction forces based on the time data for the hookload, the WOB, and the torque.

3. The method of claim 2, wherein identifying the abnormal friction forces includes identifying a sticking event.

4. The method of claim 1, wherein generating the friction forces includes generating a rotational friction force.

5. The method of claim 1, wherein generating the friction forces includes generating the friction forces parallel to a longitudinal axis of the wellbore.

6. The method of claim 1, wherein generating the friction forces includes generating a side force in a dogleg of the wellbore.

7. The method of claim 1, wherein generating the friction forces includes generating the friction forces in real-time.

8. The method of claim 1, further comprising generating a hookload plot of friction factors associated with the friction forces plotted against depth, and wherein identifying the section of steady-state motion includes identifying the section of steady-state motion based on a slope of the friction forces on the hookload plot.

9. The method of claim 1, wherein determining the steady-state forces includes determining the steady-state forces based on a shape of the wellbore.

10. A method, comprising:

receiving drilling data for a period for a drill string in a wellbore, wherein receiving the drilling data includes receiving the drilling data while performing a drilling activity with a drill rig state, the drilling data including hookload data, weight-on-bit (WOB) data, and torque data, the drill string having a drill pipe length and a specification weight;

applying a friction model to the drilling data, the friction model resulting in a friction force for the drill string;

using the friction force, the drill pipe length, and the drilling data over the period, identifying an adjusted linear weight of the drill string;

generating a determined hookload using the friction model; and while performing drilling activities in a period of reduced axial friction, calibrating the friction model based on a hookload difference between the hookload data and the determined hookload, resulting in a calibrated friction model, wherein calibrating the friction model includes making iterative changes to inputs to the friction model until the hookload difference is below a calibration threshold, the inputs including the adjusted linear weight of the drill string and torque and drag factors.

11. The method of claim 10, wherein calibrating the friction model includes comparing a weight of the drill string plus a first friction force to a first hookload data to determine the hookload difference.

12. The method of claim 10, wherein applying the friction model includes generating a steady-state friction force over a first period by applying a filter to a first drilling data.

13. The method of claim 10, further comprising:

receiving third drilling data for a third period, the third drilling data including third hookload data, third WOB data, and third torque data;

applying the calibrated friction model to the third drilling data, resulting in a third friction force; and based on the third friction force, identifying a sticking event for the drill string in the wellbore.

14. A system, comprising:

a processor and memory, the memory including instructions that cause the processor to:

receive, for a period of time while performing a drilling activity with a drill rig state, time data for hookload, weight-on-bit (WOB), and torque for a wellbore, wherein the period of time is based on a duration of time that it takes to adjust a total drill pipe length of a drill string, the drill string having a specification weight;

using the time data for the hookload, the WOB, and the torque for the wellbore, identify a section of steady-state motion in the wellbore over the period of time, wherein, in the section of steady-state motion, the drill string in the wellbore has reduced axial friction;

generate friction forces for the section of steady-state motion by applying a friction model to the time data for the hookload, the WOB, and the torque;

use the friction forces, the total drill pipe length, and the time data for the hookload over the period of time, identifying an adjusted linear weight of the drill string;

calibrate the friction model based on the adjusted linear weight of the drill string, resulting in a calibrated friction model;

generate adjusted friction forces by applying the calibrated friction model to the time data for the hookload, the WOB, and the torque; and adjust the drilling activity based on the adjusted friction forces.

15. The system of claim 14, wherein the memory further causes the processor to identify abnormal friction forces based on the time data for the hookload, the WOB, and the torque.

16. The system of claim 15, wherein identifying the abnormal friction forces includes identifying a sticking event.

17. The system of claim 14, wherein generating the friction forces includes generating a rotational friction force.

18. The system of claim 14, wherein generating the friction forces includes generating the friction forces parallel to a longitudinal axis of the wellbore.

19. The system of claim 14, wherein generating the friction forces includes generating a side force in a dogleg of the wellbore.

20. The system of claim 14, wherein generating the friction forces includes determining a difference between the hookload and an in-situ weight of the drill string, the in-situ weight of the drill string based at least in part by a buoyancy of a drilling fluid.

* * * * *